US006062347A

United States Patent [19]

Traktovenko

[11] Patent Number: 6,062,347

[45] Date of Patent: May 16, 2000

[54] RESIN STOP ASSEMBLY FOR ROLLER GUIDES

[75] Inventor: Boris G. Traktovenko, Avon, Conn.

[73] Assignee: Otis Elevator, Farmington, Conn.

[21] Appl. No.: 09/191,015

[22] Filed: Nov. 12, 1998

[51] Int. Cl.[7] ..... B66B 7/04

[52] U.S. Cl. ..... 187/410; 187/409; 267/153; 267/140

[58] Field of Search ..... 187/409, 410; 267/139, 140, 153, 293

[56] References Cited

U.S. PATENT DOCUMENTS

| | | | |
|---|---|---|---|
| 3,752,462 | 8/1973 | Wight, Jr. | 267/140 |
| 3,856,117 | 12/1974 | Solymos | 187/410 |
| 4,434,876 | 3/1984 | McKechnie | 187/410 |
| 4,732,371 | 3/1988 | Pflederer | 267/52 |
| 4,837,976 | 6/1989 | Westfall et al. | 49/430 |
| 5,107,963 | 4/1992 | Rocca et al. | 187/410 |
| 5,632,358 | 5/1997 | Maeda et al. | 187/410 |
| 5,811,743 | 9/1998 | Kohara et al. | 187/393 |

FOREIGN PATENT DOCUMENTS

| | | | |
|---|---|---|---|
| 001098570 | 8/1955 | France | 187/409 |
| 002013252 | 3/1970 | France | 187/409 |
| 00016017 U | 10/1956 | Germany | 187/410 |
| 000320063 | 4/1957 | Switzerland | 187/409 |
| 000707879 | 1/1980 | U.S.S.R. | 187/409 |
| 000787386 | 12/1957 | United Kingdom | 187/410 |

*Primary Examiner*—Robert P. Olszewski
*Assistant Examiner*—Steven B. McAllister

[57] ABSTRACT

An elevator system 10 includes an elevator car 12 with a plurality of roller guide assemblies 20 attached hereto. The roller guide assemblies 20 guide the elevator car 12 vertically within a hoistway along a plurality of guide rails 16. Each roller guide assembly 20 includes at least one resin stop assembly 50 to minimize vibration and lateral movement of the elevator car 12. The resin stop assembly 50 includes a resin spring 52 adjacent to a rigid container 54, both coupled between a roller wheel arm 26 and the roller guide base 40. The resin stop assembly 50 improves the ride quality of the elevator car 12 by selectively limiting lateral acceleration and velocity of the elevator car 12.

2 Claims, 3 Drawing Sheets

FIG.3
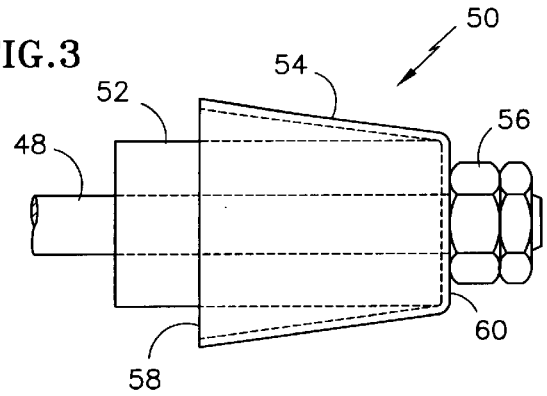
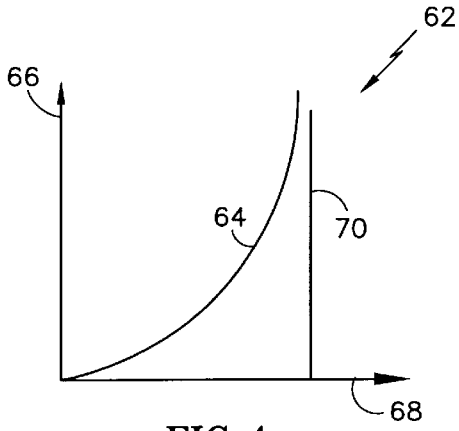
FIG.4
FIG.5
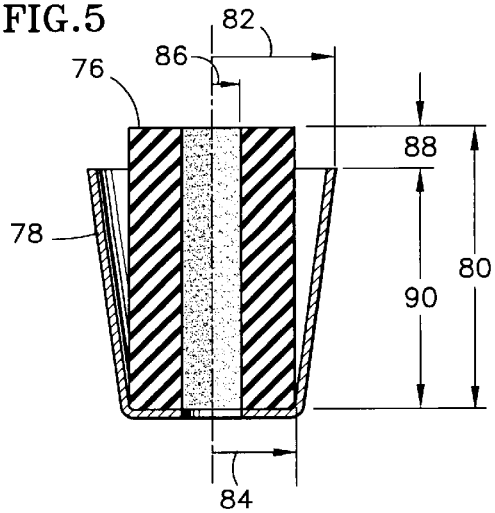
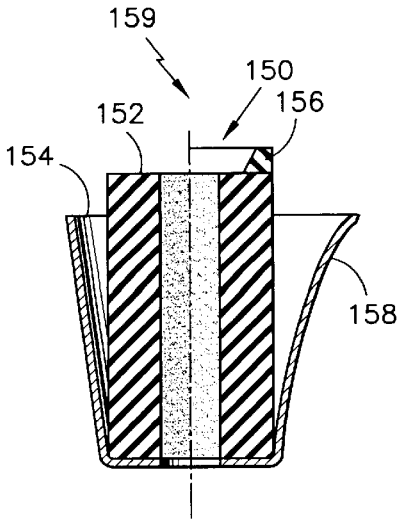
FIG.6
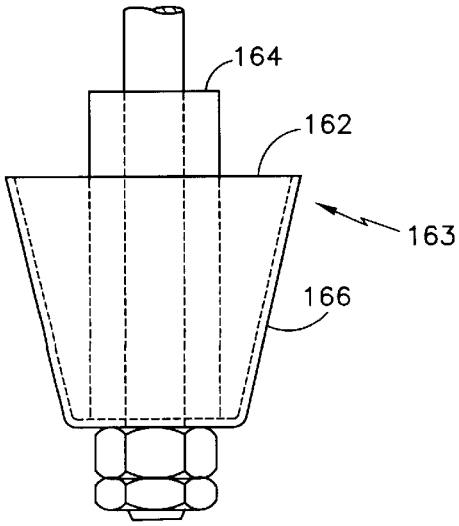
FIG.7

RESIN STOP ASSEMBLY FOR ROLLER GUIDES

FIELD OF THE INVENTION

The present invention relates to elevator systems and, more particularly, to a suspension with a progressive spring rate.

BACKGROUND OF THE INVENTION

A typical elevator system comprises an elevator car and counterweight, each suspended on opposite ends of hoist ropes which are disposed in an elevator hoistway. The elevator system also includes at least two sets of guide rails extending the length of the elevator hoistway, with each set of guide rails being disposed on opposite sides of the hoistway. The guide rails guide a plurality of roller guides attached to the elevator car. The roller guides ensure a smooth ride by preventing any unevenness of the rails from being transmitted to the elevator car.

There are several factors that impact the quality of the elevator car ride. One such factor is the total length of the hoistway. Longer hoistways require a greater number of guide rail segments stacked within the hoistway and a greater number of joints between the guide rail segments. A greater number of guide rail segments result in greater total weight of the guide rails, and the resultant loading causes the rails to deflect. Also, the joints between the guide rails result in some discontinuity. Even slightly deflected rails and minimal discontinuity in joints cause the elevator car to vibrate and move laterally.

Another factor that adversely affects ride quality is an aerodynamic consideration. During vertical travel of an elevator car within the hoistway, aerodynamic pulses from the hoistway doors and an aerodynamic pulse from the counterweight cause lateral movement and vibration in the elevator car.

To minimize the adverse impact of rail imperfections and aerodynamics on the ride quality of the elevator car, a conventional roller guide assembly includes a suspension system and a damping system. The suspension system typically comprises a helical spring and a stop associated with each roller of the roller guide assembly to restore the roller to its original position after the roller has been deflected by imperfections in the guide rails.

It is desirable to have a relatively soft suspension system to isolate the elevator car from rail imperfections. The helical springs provide a soft ride quality while the relatively rigid stops prevent the elevator car from contacting the rails in case the helical springs become completely compressed. The quality of the ride is greatly reduced when the car contacts or rides the stop because the relatively rigid stop transmits rail imperfections to the elevator car. In addition, the transition from riding on the helical spring to riding on the stop subjects the elevator car to a small shock.

A problem arises when an elevator car is unbalanced, which can occur during normal usage. This unbalance partially compresses the helical springs, reducing the clearance between the elevator car and the stops. The movement of the elevator car, which produces a dynamic side-to-side motion, together with the already compressed springs, can result in the elevator car impacting and possibly riding on the stops. Since the stops are relatively rigid, they transmit any unevenness in the rails to the occupants of the elevator car.

Another problem with current suspensions is that helical springs provide very little damping of oscillations of an elevator car, so special damping devices are added. Existing damping systems comprise a hydraulic cylinder to reduce vibration. However, the hydraulic damping system increases the stiffness of the suspension system which is not desirable because of the resulting increase in guide rail excitations transmitted to the car, which in-turn increases vibrational response. Additionally, hydraulic damping systems require regular maintenance, sustain wear, and increase cost of the overall system.

SUMMARY OF THE INVENTION

It is an object of the present invention to provide a smooth ride quality for both balanced and unbalanced elevators.

An elevator system of the present invention includes an elevator car adapted to travel up and down within a hoistway. There is a roller guide assembly affixed to the elevator car which is adapted to slidably engage guide rails within the hoistway. The roller guide assembly also includes a roller assembly for urging the roller laterally against the guide rail surface. There is a resin stop assembly for reducing the vibration of the elevator car as it travels up and down within the hoistway. The resin stop assembly is coupled to the roller guide assembly and selectively limits lateral acceleration and velocity of the roller relative to the guide rail surface. In a preferred embodiment of the present invention, the resin stop assembly includes a deformable resin spring and a rigid container into which the resin spring is pressed when a force is exerted on it by the lateral motion of the elevator car.

One major advantage of the present invention is that elevator car ride quality is not seriously effected by uneven guide rails or aerodynamic pulses.

Another advantage of the present invention is that special damping devices do not need to be added to the suspension system, reducing the cost and time of assembly and maintenance.

The foregoing and other advantages of the present invention become more apparent in light of the following detailed description of the exemplary embodiments thereof, as illustrated in the accompanying drawing.

BRIEF DESCRIPTION OF THE DRAWINGS

FIG. 3 is an enlarged side view of a resin stop assembly shown in FIG. 2;

FIG. 4 is a graph of the spring rate for the resin stop assembly of FIG. 3 showing force versus displacement;

FIG. 5 is a cross-sectional view showing dimensions of the resin stop assembly shown in FIG. 3;

FIG. 6 is a cross-sectional view of a second embodiment of a resin stop assembly of FIG. 3 provided by the present invention;

FIG. 7 is a cross-sectional view of a third embodiment of a resin stop assembly provided by the present invention.

DETAILED DESCRIPTION OF THE PREFERRED EMBODIMENTS

Figure 1:
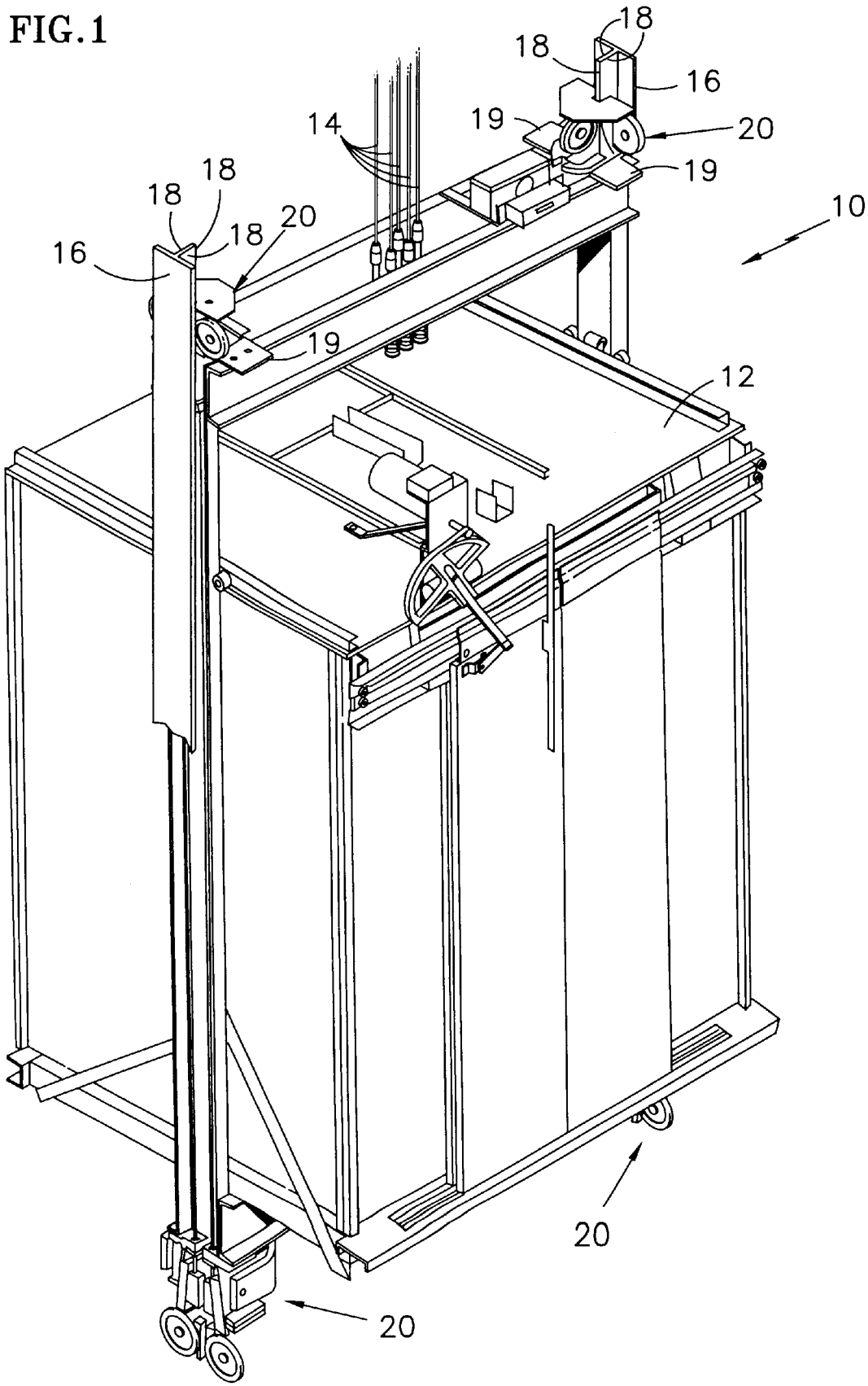
FIG. 1 is a front view of a conventional elevator car in a hoistway.

In FIG. 1, an elevator system 10 includes an elevator car 12 suspended from hoistway ropes 14 and riding along guide rails 16 within a hoistway (not shown). Ancillary mounting brackets 19 affix a plurality of roller guide assemblies 20 to the elevator car 12. The roller guide assemblies 20 slidably engage the guide rails 16 along guide rail surfaces 18. In the preferred embodiment, the guide rail 16 has three guide rail surfaces 18.

Figure 2:
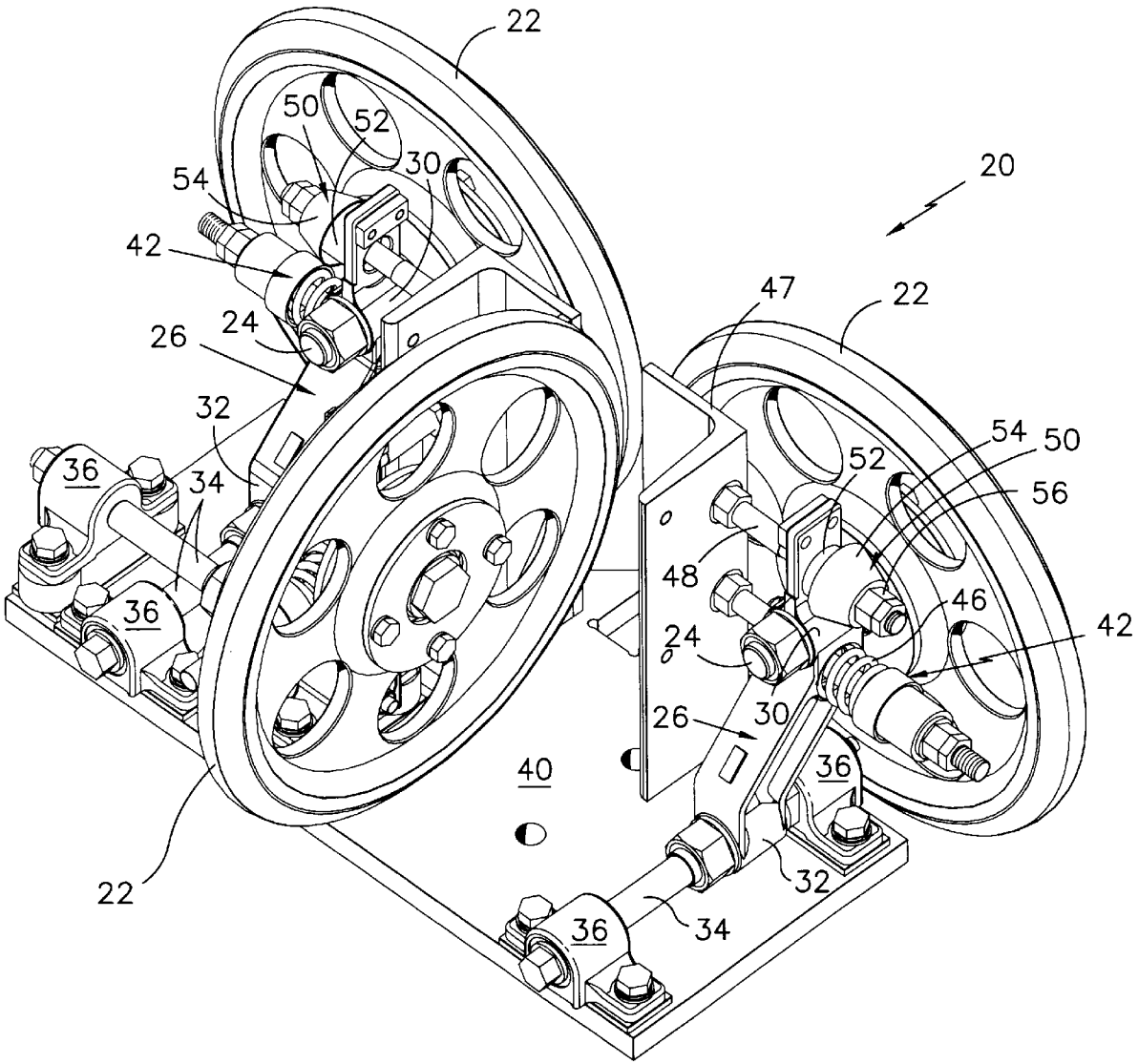
FIG. 2 is a front view of a first embodiment of an elevator roller guide of the elevator car of FIG. 1.

As shown in FIG. 2, each roller guide assembly 20 includes a plurality of rollers 22 each of which engages the guide rail 16 along the guide rail surface 18. Each roller guide assembly 20 includes a means of urging the roller 22 laterally against the guide rail surface 18, such as a suspension assembly 42 having a restoring spring 46. Each roller 22 also includes a roller axle 24 passing through a center of the roller and a translating lever roller wheel arm 26 with a first arm end 30 fixedly attaching to the roller axle 24 and with a second arm end 32 fixedly attaching to a pivoting shaft 34. The pivoting shaft 34 rotates within bushings 36 which are fixedly attached to a roller guide base 40 of the roller guide assembly 20.

Each roller guide assembly 20 also includes a suspension assembly 42 which includes the restoring spring 46 pressed against the first arm end 30 of the roller wheel arm 26. The restoring spring 46 urges the roller 22 in a lateral direction against the guide rail surface 18. An arm brace 47 is embedded in the roller guide base 40 and supports a support rod 48 which is inserted through the roller wheel arm 26. The first arm end 30 rocks laterally towards and away from the arm brace 47 and the guide rail surface 18. Each roler guide assembly 20 also includes a resin stop assembly 50 mounted between a nut 56, which is threaded on the support rod 48, and the roller wheel arm 26.

As shown in FIGS. 2 and 3, the resin stop assembly 50 includes a rigid container 54, which in the preferred embodiment consists of a frustoconical container of steel, whose wider, open end 58 is oriented towards the roller wheel arm 26, and whose narrower, closed end 60 engages the nut 56. The rigid container 54 and the resin spring 52 have a substantially equal volume, therefore the resin spring substantially fills the rigid container under the maximum applied force. While a rigid container 54 composed of steel has been described, the present invention is not limited in this regard as other materials which will not deform under pressure can be substituted without departing from the broader aspects of the present invention.

Additionally, the present invention is not limited to certain complementary geometries, as other shaped rigid containers may be substituted which have substantially the same volume as the resin spring and a gap which can be filled by the resin spring when force is applied. Note also that the rigid container and resin spring geometries can be reversed; e.g., a conical shaped resin spring to be received by a cylindrical container, without departing from the broader aspects of the present invention.

The resin stop assembly 50 also includes the resin spring 52, which in the preferred embodiment is a rubber ring, which partially fills the rigid container 54 before force is applied and is engaged by the roller wheel arm 26. While a resin spring 54 shaped as a ring and composed of rubber has been described, the present invention is not limited in this regard as any polymeric material and other shapes can be substituted without departing from the broader aspects of the present invention. Also, it may be desirable in certain applications to size the resin spring-rigid container combination so that the resin spring has a slightly larger volume, thereby precluding the possibility of a metal-to-metal contact when fully compressed.

The present invention uses that fact that a resin that is under pressure does not change volume, but instead deforms. If the deformation is constrained by being forced into a rigid container, the stiffness of the resin increases smoothly and rapidly. As the volume, $V_1$ 76, of the resin spring 52 substantially equals the volume, $V_2$ 78, of the rigid container 54, the resin cannot be further compressed.

As shown in FIG. 4, the force versus displacement graph 62 of the resin spring 52 shows the spring rate 64 for a particular resin. The spring rate 64 increases smoothly with an increase in force 66 and the corresponding increase of displacement 68 of the resin spring 52. There are no sudden bends or changes in the spring rate 64 which would be passed on to the elevator car 12 as bumps or jolts. The travel limit 70, which is the maximum displacement 68 allowed for the elevator car, will not be reached.

The spring rate 64 is different for different resins. The spring rate 64 for a particular resin in substantially cylindrical form is characterized by the following equation:

$$K=EA/h_1(N/m) \tag{1}$$

wherein K is the spring rate 64 of the resin spring 52, E is an effective Young's modulus of the resin spring in N/meter, A is the cross-section area of the resin spring in meters squared, and $h_1$ 80 is the height of the resin spring in meters. For a chosen resin, the Young's modulus E and the strength for compression is known. For a given elevator system, the maximum force on the suspension is known, and therefore the cross-section area A of the resin can be chosen. From formula (1) and knowing E, and A and after choosing the desired spring rate K, $h_1$ 80, the height of the resin spring will be defined.

As shown in FIG. 5, for the preferred embodiment of a cone shaped rigid container 54, the size and shape are configured by determining the maximum amount of distance, d 88 that the roller wheel arm 26 is allowed to displace. This is the height 88 the resin spring 52 projects above the rim of the rigid container 54 without a load. The total height of the rigid container $h_2$ 90 is $$h_2=h_1-d \tag{2}$$

which is the total height of the resin spring 52 minus the maximum distance d 88 that the resin spring is allowed to be compressed.

Further referring to FIG. 5 and equation (3), the size and shape of the preferred embodiment of a cone shaped rigid container can be calculated.

$$R_2=\sqrt{\left(\frac{2d}{h_2}+1\right)R_1^2-\frac{2d}{h_2}r_1} \tag{3}$$

$R_2$ 82 is the top, larger radius of the cone shaped rigid container, $R_1$ 84 is the outer radius of the resin spring, and $r_1$ 86 is the inner radius of the resin spring in the case where the resin spring is assembled as a ring around a bolt. The value of $r_1$ 86 is zero if the resin spring 52 is a solid body. Using formulas (1), (2) and (3), all parameters for the resin stop assembly 50 can be calculated.

In the preferred embodiment, the resin stop assembly 50 is placed in parallel with helical springs 46. The initial preloading of the suspension assembly 42 will be done mostly by the helical springs 46. The resin stop assembly 50 will be moved in to make initial contact with the roller wheel arm 26 when the elevator car 12 is in the balanced position and at rest.

In operation, as the elevator car 12 moves up and down the hoistway, each roller guide assembly 20 engages the corresponding guide rail 16 along the guide rail surfaces 18 and is guided thereby, as best seen in FIG. 1. As the roller guide assemblies 20 of the elevator car ride along the guide rails 16 and guide rail surfaces 18, each roller 22 rotates about the roller axle 24, as best seen in FIG. 2. Each roller 22 is subjected to vibrations and lateral movements as a result of imperfections associated with the guide rails 16 and guide rail surfaces 18 and as a result of aerodynamic effects within the hoistway. The lateral movement of each roller 22 results in movement of the corresponding roller wheel arm 26, rocking in a lateral direction towards and away from the corresponding arm brace 47, which is attached to the roller guide base 40. The roller wheel arm 26 is fixedly attached to the roller axle 24. The pivoting shaft 34, fixedly attached to the second arm end 32 of the roller wheel arm 26, then rotates within the bushings 36.

As the roller wheel arm 26 deflects, the resin stop assembly 50 forces the roller wheel arm 26 and consequently the corresponding roller 22 into its original position. The resin stop assembly 50 selectively limits lateral acceleration and the lateral velocity of the roller 22 relative to the guide rail surface 18, which reduces the vibration of the elevator car 12. The rigid container 54 and the resin spring 52 have a substantially equal volume, therefore the resin spring completely deforms into and substantially fills the rigid container under the maximum applied force which occurs when the roller wheel arm 26 has moved the maximum distance 70 allowed.

The operation of the resin stop assembly 50 is characterized by a plot of force v. displacement 62 as shown in FIG. 4. As the roller wheel arm 26 is deflected, a force 66 is applied to the resin stop assembly 50 which results in a displacement 68 of the elevator car 12 of the resin spring 52 in accord with the spring rate 64. As more force 66 is applied the elevator car 12 is displaced in a smooth progressive manner without degrading ride quality, even up to the travel limit 70 of the elevator car.

One advantage of the present invention is that special damping devices do not need to be added to the suspension subassembly system, reducing the cost and time of assembly. The inherent hysteresis or other nonelastic characteristic of the resin spring 52 provides damping which typically eliminates the need for additional damping devices.

The damping characteristics of the resin stop assembly are determined by the relative shapes of the resin spring and the rigid container. In the preferred embodiment of the present invention the resin spring of the resin stop assembly 50 has a volume substantially equal to the volume of the rigid container 54, resulting in a resin stop assembly that has a smooth nonlinear damping response as shown in FIG. 4. In other embodiments of the present invention, such as resin stop assembly 159 shown in FIG. 6, local addition or subtraction of resin will change the spring rate 64 in a predetermined area of compression. For example, adding a resin ring 156 to the top end of the resin spring 152 will give extra compliance during the beginning of an application of force 66. In addition, the side wall 158 of the rigid container 154 or the resin spring 152 can be curved, causing a change in the filling of the rigid container, and therefore a different spring rate 64.

In yet another embodiment of the present invention shown in FIG. 7, rigid container 162 of resin stop assembly 163 can be configured to have an internal size that is greater than that of the resin spring 164 when the resin spring 164 is not deformed. When a force is initially applied, the resin spring does not immediately contact the sides of the interior of rigid container 166. In this embodiment, of the resin stop assembly has a linear response until it is deformed to the point that the resin spring contacts the sides of the rigid container 166. Thereafter, the rigid container has the same volume as the resin spring so that the damping response of the resin stop assembly becomes smoothly nonlinear as seen in FIG. 4.

While the present invention has been illustrated and described with respect to a particularly preferred embodiment thereof, it will be appreciated by those of ordinary skill in the art, that various modifications to this invention may be made without departing from the spirit and scope of the present invention. For example, positioning the present invention in different locations between the translating roller wheel arm 26 and the roller guide base 40 works equally well. Also, the present invention functions properly regardless whether the resin spring 52 is coupled to the roller wheel arm 26 and the rigid container 54 coupled to the roller guide base 40 or the resin spring is coupled to the roller guide base and the rigid container is coupled to the roller wheel arm.

What is claimed is:

1. An elevator system comprising:

an elevator car adapted to travel up and down within a hoistway;

a guide rail extending along a length of said hoistway, and including a guide rail surface;

a roller guide assembly affixed to said elevator car and slidably engaging said guide rail, said roller guide assembly including a roller, a roller guide base, a roller wheel arm, coupled in a freely rockable manner to said roller guide base and rockable in a lateral direction to said guide rail surface, and rotatably coupled to said roller, and means for urging said roller laterally against said guide rail surface; and a resin stop assembly coupled to said roller guide base and said roller wheel arm for selectively limiting lateral acceleration and velocity of said roller relative to said guide rail surface, in order to thereby reduce vibration of said elevator car, said resin stop assembly comprising a frustoconical rigid container coupled between said roller guide base and said roller wheel arm and a cylindrical resin spring having a volume encompassed by its outer surface substantially equal to the volume encompassed by the inner surface of said rigid container, said resin spring being deformable into said rigid container upon relative movement between said roller guide base and said roller wheel arm, said rigid container having a wider, open end for inserting said resin spring and a narrower, closed end.

2. An elevator system comprising:

an elevator car adapted to travel up and down within a hoistway;

a guide rail extending along a length of said hoistway, and including a guide rail surface;

a roller guide assembly affixed to said elevator car and slidably engaging said guide rail, said roller guide assembly including a roller, a roller guide base, a roller wheel arm, coupled in a freely rockable manner to said roller guide base and rockable in a lateral direction to said guide rail surface, and rotatably coupled to said roller, and means for urging said roller laterally against said guide rail surface; and a resin stop assembly coupled to said roller guide base and said roller wheel arm for selectively limiting lateral acceleration and velocity of said roller relative to said guide rail surface, in order to thereby reduce vibration of said elevator car, said resin stop assembly comprising a frustoconical rigid container coupled between said roller guide base and said roller wheel arm, and a resin spring adapted to be received by said rigid container, the smaller end of said rigid container having an inner dimension greater than an outer dimension of said resin spring when said resin is not deformed, said resin spring thereby initially being linearly deformable into said rigid container upon initial relative movement between said roller guide base and said roller wheel arm, and said resin spring attaining said outer dimension equal to said inner dimension as said spring is deformed, the outer surface of said resin spring having a volume substantially equal to the volume of said rigid container, said resin spring thereby being subsequently nonlinearly deformable upon further relative movement between said roller guide base and said roller wheel arm.

* * * * *